United States Patent [19]

Oxley

[11] Patent Number: 4,772,053

[45] Date of Patent: Sep. 20, 1988

[54] STORAGE CHAMBER CROSS BAR ASSEMBLY

[76] Inventor: Randall C. Oxley, 1011 High St., Bridgewater, Mass. 02324

[21] Appl. No.: 65,890

[22] Filed: Jun. 24, 1987

[51] Int. Cl.[4] ..... E05C 19/18

[52] U.S. Cl. ..... 292/259 R

[58] Field of Search ..... 292/286, 259, 260, 262, 292/338, 288, 305

[56] References Cited

U.S. PATENT DOCUMENTS

| | | | |
|---|---|---|---|
| 2,163,206 | 6/1939 | Lopez | 292/259 |
| 2,373,783 | 4/1945 | Schlifer | 292/259 X |
| 2,421,275 | 5/1947 | Lopez | 292/259 |
| 3,280,606 | 10/1966 | Howard et al. | 292/259 |
| 3,592,497 | 9/1969 | Logan, Jr. | 292/259 |
| 3,665,736 | 5/1972 | Wilson | 292/259 R X |

*Primary Examiner*—Richard E. Moore

*Attorney, Agent, or Firm*—Lahive & Cockfield

[57] ABSTRACT

A vandal-proof cross bar assembly for securing the door of a refrigerated storage vault or similar chamber includes first and second mounting members secured on opposing sides of the door, and a cross bar each end of which is secured to a mounting member by a respective shackle lock. The locks attach to pivot posts extending from the mounting members. The posts pivot freely about a first axis, and the shackles each define a loose hinge about a second orthogonal axis, so that with one lock detached, the cross bar hangs freely and moves in a multi-axis articulated motion which prevents vandalism by prying and forcing the bar. In a preferred embodiment the mounting members are placed on adjacent exterior walls of the chamber and an L-shaped cross bar having a main bar and a shorter leg portion fits about a corner to engage the members and secure the door. The main bar pivots about the longitudinal axis of the shorter leg portion.

6 Claims, 2 Drawing Sheets

STORAGE CHAMBER CROSS BAR ASSEMBLY

TECHNICAL FIELD

The present invention relates to cross bar assemblies and similar devices for securing the door of a freezer, storage vault or like chamber. In general, such a cross bar assembly includes a strong bar member which is placed across an outwardly opening door, and secured by means of a padlock whose shackle passes through one end of the bar, so as to prevent unauthorized opening of the door or entry to the chamber.

In the case of food storage vaults, i.e, freezers and refigeration chambers used in a store or restaurant business, the cross bar assembly is left unlocked during a substantial portion of the working day in which access to the vault is required. This leaves the cross bar assembly prone to vandalism, because in its unlocked condition it is generally possible to pry against the mounting of the cross bar using the massive leverage of the cross bar itself, so as to bend or misalign the parts to such an extent that the cross bar cannot be re-secured at closing time.

OBJECTS AND SUMMARY OF THE INVENTION

Accordingly, it is an object of the invention to provide a cross bar assembly for a storage chamber having a structure which is not susceptible to self vandalism by applying force, leverage and the like.

It is a further object of the invention to provide a pivoting or articulated cross bar assembly for a storage chamber.

These and other features of the invention are obtained in a cross bar assembly for a storage chamber consisting of first and second cross bar receiving securing members and an elongate bar member adapted to extend from one securing member to the other and be loosely hinged thereto. Each securing member includes a base plate adapted for fastening adjacent to a door of the chamber and an anchor member affixed to the base plate for pivotal motion with respect to the plate about an axis perpendicular thereto. The anchor member includes means, such a shackle receiving aperture, for loosely releasably coupling to the cross bar. Each end of the cross bar has a corresponding coupling member.

In one embodiment, the cross bar is an L-shaped cross bar having a short leg portion pivotally attached to the main portion of the bar. The base plates are mounted on the face and side of the storage chamber for coupling with the main and leg portions of the cross bar, respectively. In his manner, when uncoupled from an anchor member at either end, the cross bar assembly moves freely about a plurality of axes without self leverage, preventing the bending or disabling of the assembly by vandalism.

The invention will be understood from the following description taken together with the FIGS. wherein:

DETAILED DESCRIPTION OF THE DRAWINGS

Figure 1:
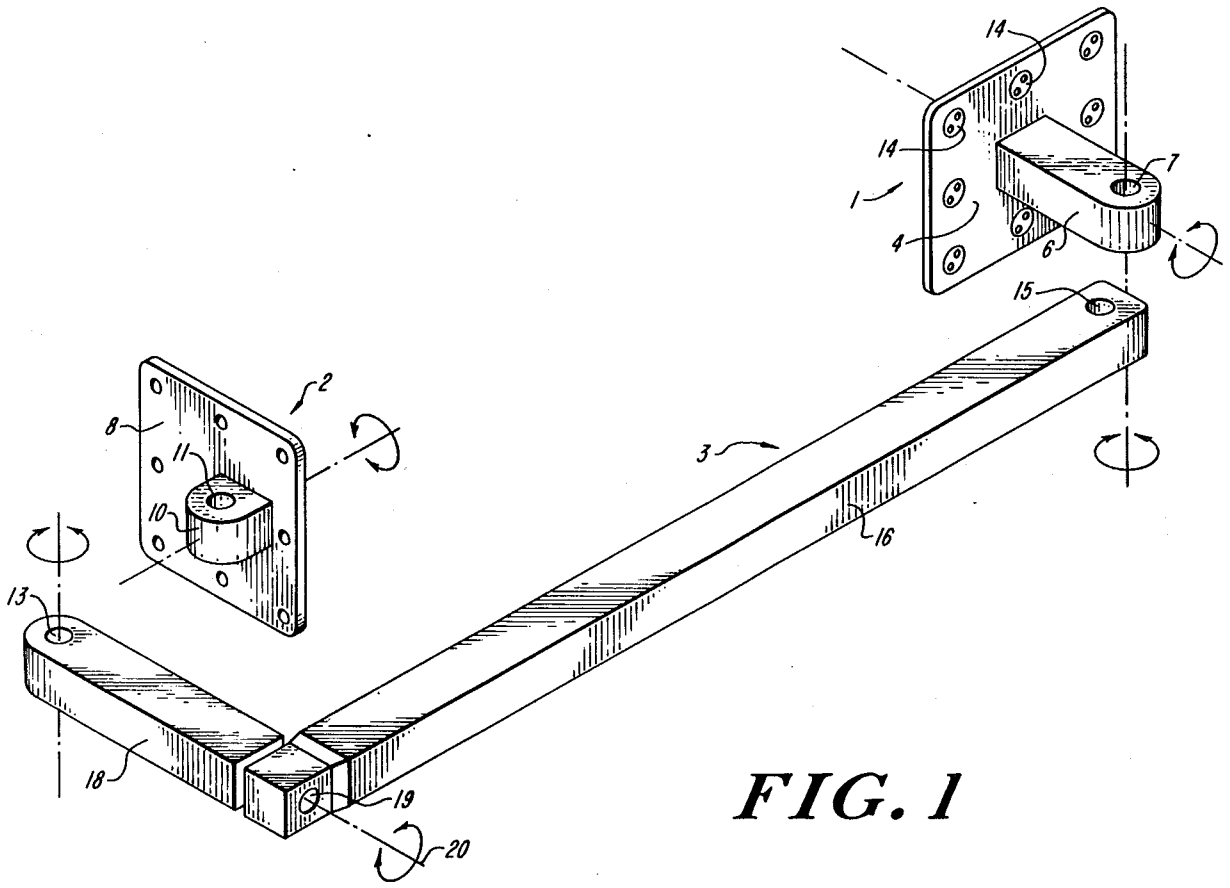
FIG. 1 is a schematic perspective view of a cross bar assembly according to one preferred embodiment of the invention.

FIG. 1 shows a perspective view of one preferred construction of a cross bar assembly according to applicant's invention. As shown, the assembly includes first and second securing members 1, 2 and a cross bar 3 which extends between the securing members for securing the outside of a storage chamber and preventing a door thereof from opening. Each securing member consists of a base plate 4, 8 and an anchor member 6, 10. Each anchor member is secured to its corresponding base plate by a blind attachment from behind (not shown) which allows pivotal motion of the anchor member about an axis perpendicular to the base plate. Each anchor member also has a shackle hole 7, 11 at the outward end thereof for receiving the shackle of a padlock. As illustrated, the base plates are drilled for a plurality of mounting screws or bolts 14 which as shown, are spanner head bolts having vandal-procf heads.

In the illustrated embodiment, the two base plates are mounted on adjacent exterior sides of storage chamber, so that they are at right angles to each other. The cross bar extends from one base plate to the other and includes a shackle hole 13, 15 at each end of the bar. Thus, when a padlock is inserted through holes 11, 13 at one end and 7, 15 at the other end, the cross bar will, owing to its dimensions and the spacing of the base plates, be securely mounted across the door of the storage chamber. Further, when a padlock is removed at one end, the cross bar assembly will pivot freely with loose hinge-like motion about the axis defined by the shackle holes and the shackle securing the other end, and will also pivot about the pivot axis of the anchor member 6 or 10 to which it is attached.

Turning now to the preferred construction of the cross bar 3 itself, the illustrated cross bar includes a first or main section 16 and a second or leg section 18 which together with the main section defines a generally L-shaped member. Leg 18 is secured to main section 16 by a pivot pin 19 oriented along the long axis 20 of the leg, mounting section 16 for pivotal motion about the axis. Thus, the cross bar constitutes an articulated arm.

In the arrangement shown, if the shackle connecting the main bar to securing member 1 is removed, the main bar simply swings down about axis 20 to clear the doorway. Conversely, if the shackle connecting the leg bar to securing member 2 is removed, the bar may pivot outward about the axis defined by the remaining shackle and pivot downward about the pivot axis of securing member 6 to hang freely at the opposite side of the door. In either case, an attempt to move the main bar 16 into an irregular position or to exert leverage on the anchor members, securing member or portions of the cross bar simply results in a limp multi-axis floppy articulated movement of the arm without applying destructive force thereto. Thus, the construction of the present invention incorporates mechanical couplings which may be desribed as "universal joint" coupling so as to achieve both a flexibility of access when the cross bar is unshackled, and an immunity to vandalism.

Figure 2:
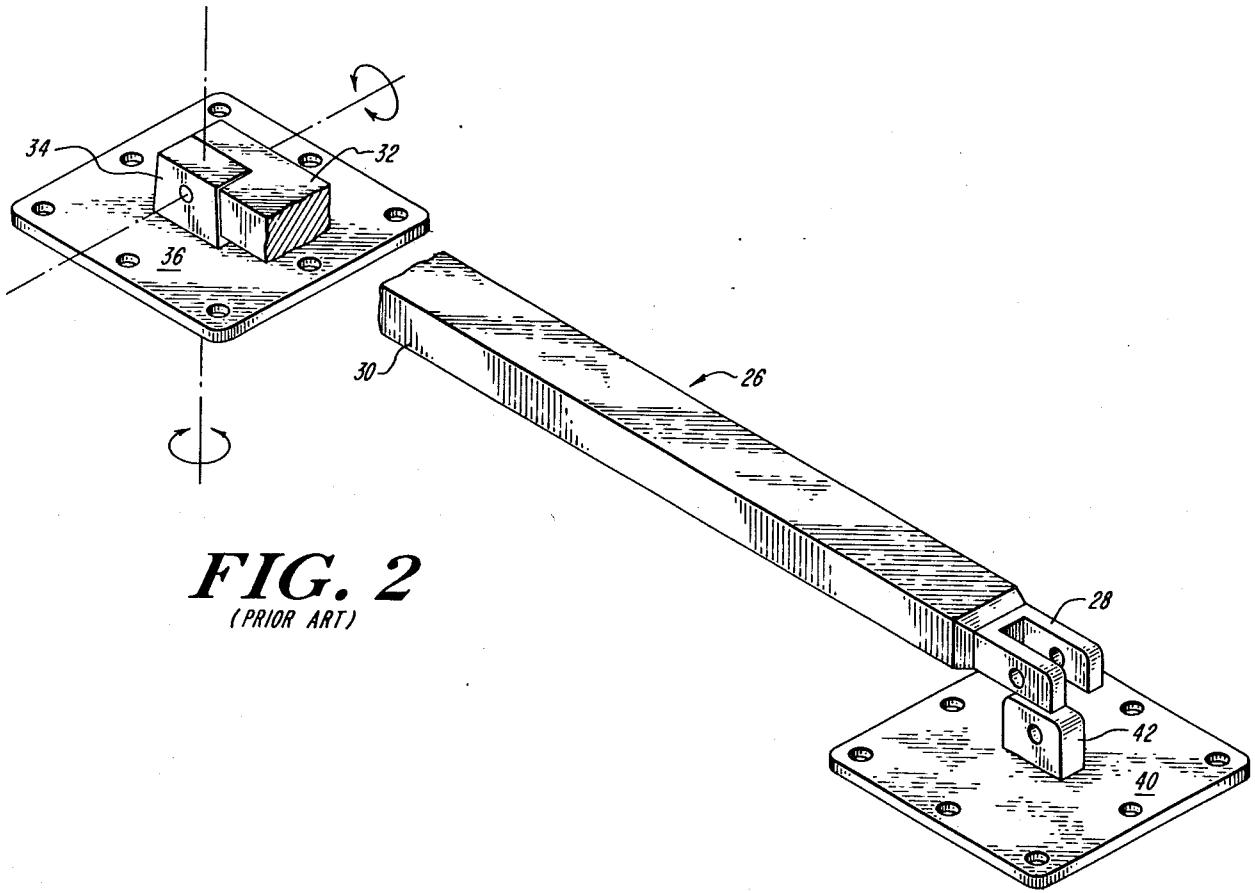
FIG. 2 (PRIOR ART)
FIG. 2 is a schematic perspective view of a prior art cross bar assembly, illustrative of alternative details of construction.

Variations in construction will be understood by reference to FIG. 2, which shows a prior art cross bar assembly. In this construction, a cross bar 26 is formed as a hollow tubular member having a first end with a shackle receiving slotted tip 28 and a second hollow tubular end 30, End 30 fits over a corresponding protruding stub 32 which is pin-mounted for pivtal motion about a post 34 which in turn is rotatably mounted on a mounting plate 36. At the other end, a conventional mounting plate 40 having an eye 42 firmly secures the cross bar 26 across a doorway when the tubular member is fitted over the stub 32.

The foregoing cross bar assembly enjoys some of the advantages of the invention in having a pivotal bar engaging mounting, stub member 34, 32, which is relatively immune to vandalism. However, since the main cross bar 26 has a single locking end and is removable, it may be concealed or misplaced to disable the whole assembly, and thus the assembly as a whole remains prone to vandalism. Thus, this prior art construction does not offer the advantages of the invention shown in FIG. 1.

The invention having been described with regard to a particular illustrated embodiment thereof, further modifications and variations will occur to those skilled in the art, and all such modifications and variations are intended to be within the scope of the invention, as defined by the following claims.

What is claimed is:

1. A cross bar assembly for securing when locked a storage chamber door while permitting when unlocked convenient removal of the cross bar therefrom for access to the chamber, such assembly comprising (A) a first and a second cross bar securing member, each said securing member including (i) a base plate adapted for fastening adjacent the door, and (ii) an anchor member affixed to the base plate for pivotal motion with respect to the plate about a pivot axis perpendicular thereto, each said anchor member including first coupling means for loosely releasably coupling to a cross bar, and (B) a cross bar having first and second ends, each said end including means for providing a loose hinged coupling mating with the first coupling means of a said securing member so as to provide two-axis motion of said cross bar at each said end.

2. A cross bar assembly according to claim 1, wherein said means for providing a loose hinged coupling includes a shackle receiving opening formed in a said securing member tranverse to said pivot axis.

3. A cross bar assembly according to claim 1, wherein said cross bar is an L-shaped cross bar for securing about an exterior corner of a storage chamber, said L-shaped cross bar comprising a first generally straight main bar portion and a shorter generally straight leg bar portion, said leg bar portion being attached to said main bar by a pivot attachment for pivoting about an axis of said leg bar portion, whereby the cross bar assembly when unlocked may move freely about a plurality of axes without self-leverage or deforming or disabling the assembly so as to prevent vandalism.

4. A cross bar assembly for securing when locked a storage chamber door while permitting when unlocked convenient access thereto, such assembly comprising a first securing member including means for mounting on a storage chamber wall and means for pivotally coupling with a cross bar, a second securing member including means for mounting on a storage chamber wall and means for pivotally coupling with a cross bar, and an L-shaped cross bar having first and second ends and an intermediate corner, with an articulated joint at said corner, each said end including a mating connector means for releasably securing to a said means for pivotally coupling of a respective said securing member.

5. A cross bar assembly for securing a door of a storage chamber, such assembly comprising first and second mounting members for attachment to the storage chamber and a cross bar having first and second ends with first and second fastening means adapted to securely pivotally fasten to and to unfasten from said respective first and second mounting members, and further including articulation means, in each mounting member, for providing pivotal motion of the member about a first axis, said mounting members and said first and second ends being fastened by said fastening means so as to pivot about a second axis, thus, providing pivotal motion to either said end with respect to said chamber about first and second axes when one said end is fastened to, and the other said end is unfastened from, its mounting means.

6. A cross bar assembly according to claim 5, further comprising a joint in said cross bar between said first and second ends for providing articulation of said cross bar about an axis of said cross bar.

* * * * *